United States Patent [19]

Colla

[11] Patent Number: 4,867,240

[45] Date of Patent: Sep. 19, 1989

[54] METHOD AND APPARATUS FOR MOLDING UNDERGROUND DIAPHRAGMS

[75] Inventor: Romano Colla, Parma, Italy

[73] Assignee: Soil Jet Co., Inc., Duncan, Okla.

[21] Appl. No.: 146,765

[22] Filed: Jan. 22, 1988

[30] Foreign Application Priority Data

Jan. 23, 1987 [IT] Italy ..... 46804 A/87

[51] Int. Cl.[4] ..... E21B 33/13

[52] U.S. Cl. ..... 166/290; 166/51

[58] Field of Search ..... 166/51, 169, 285, 287, 166/290; 118/317; 427/236, 427; 242/56.2

[56] References Cited

U.S. PATENT DOCUMENTS 2,791,886 5/1957 Veder .
3,052,298 9/1962 Malott ..... 166/290
3,326,003 6/1967 Marconi .
3,800,544 4/1974 Nakanishi .
4,441,556 4/1984 Powers et al. ..... 166/290

*Primary Examiner*—William P. Neuder
*Attorney, Agent, or Firm*—Bill D. McCarthy

[57] ABSTRACT

A method wherein a hole is made in the ground having the depth intended for a diaphragm, the hole being a narrow cylindrical cavity. Into this cavity is successively inserted a drill head including at least one ejection element having its axis aimed in a direction transverse to the axis of the cavity. The head is connected by means of a one-piece flexible tube to elements which supply the substance to be used for reinforcing and waterproofing the ground under pressure to the ejection element. The reinforcing substance is discharged through the ejection element at the same time that the head is drawn toward the surface, the axis of the ejection element being maintained in its oriented position in a controlled manner in a plane perpendicular to the axis of the cavity to form a diaphragm.

6 Claims, 4 Drawing Sheets

METHOD AND APPARATUS FOR MOLDING UNDERGROUND DIAPHRAGMS

BACKGROUND OF THE INVENTION

1. Field of the Invention

The present invention concerns the molding of diaphragms in the ground, particularly for shallow areas, in order to reinforce and/or waterproof portions of the subsoil.

In particular, the invention concerns the production of continuous barriers which are vertical or sloping, made up of several contiguous plate-like diaphragms.

2. Discussion

The technique has long been known for creating diaphragms in the ground with a substantially plate-like or cylindrical shape by injecting into the ground, through a hollow shaft also functioning as a drill, an appropriate reinforcing and waterproofing substance comprising an aggregating component such as liquid cement, soluble glass (based on sodium silicate), epoxy resins, and possible an adjuvant component such as air or water.

This reinforcing substance is injected into the ground at high pressure while the drill shaft is extracted from the ground, creating either cylindrical columns or vertical plate-like diaphragms formed by the aggregating component mixed with soil.

At their down ends these drill shafts are provided with appropriate means for perforating the ground and with internal canals for the passage of the components of the reinforcement substance. These drill shafts are made up of segments which are joined together successively during the descent, and then are separated during the ascent. This gives rise to numerous inconveniences, such as loss of time in joining and separating the various segments, complicated construction and consequently high cost of these elements. These disadvantages are more pronounced as the depth at which the diaphragms are molded increases.

To create continuous barriers, the known technique provides for the production of barriers made up of a number of contiguous plate-like diaphragms, principally to impede water filtration in certain areas of the ground. However, the production of such barriers presents a number of difficulties because of the inevitable shifting of the axes of the holes with respect to the expected ideal vertical axes. Because of this, it may happen that the vertical edges of the ends of the diaphragms are not together, and this causes discontinuities and interruptions in the barrier; these problems are more pronounced as the depth of the diaphragms is greater. The purpose of this invention, as specified in the claims, is to find a solution for these problems.

SUMMARY OF THE INVENTION

The present invention provides a method and apparatus for the production of continuous vertical or sloping barriers in the form of contiguous plate-like diaphragms in the ground. A hole is first made in the ground having the depth intended for the diaphragm, the hole being a narrow cylindrical cavity. Into this cavity is successively inserted a drill head including at least one ejection element having its axis aimed in a direction transverse to the axis of the cavity. The head is connected by means of a one-piece flexible tube to elements which supply ground reinforcing and waterproofing substance under pressure to the ejection element. The reinforcing substance is discharged through the ejection element at the same time that the head is drawn toward the surface, the axis of the ejection element being maintained in its oriented position in a controlled manner in a plane perpendicular to the axis of the cavity.

As disclosed, several cavities are made in the ground, each corresponding to one of the diaphragms, and the steps of the method above recited are repeated in such a manner that the ground reinforcing and waterproofing substance reaches the vertical end of the contiguous diaphragms previously formed.

It is the object of the present invention to provide an improved method and apparatus for molding underground diaphragm barriers.

Other objects, advantages and features of the present invention will become clear from the following detailed description when read in conjunction with the drawings and appended claims.

BRIEF DESCRIPTION OF THE DRAWINGS

The invention is described in detail below, with the help of figures showing embodiments used to apply the method.

DESCRIPTION

Figure 1:
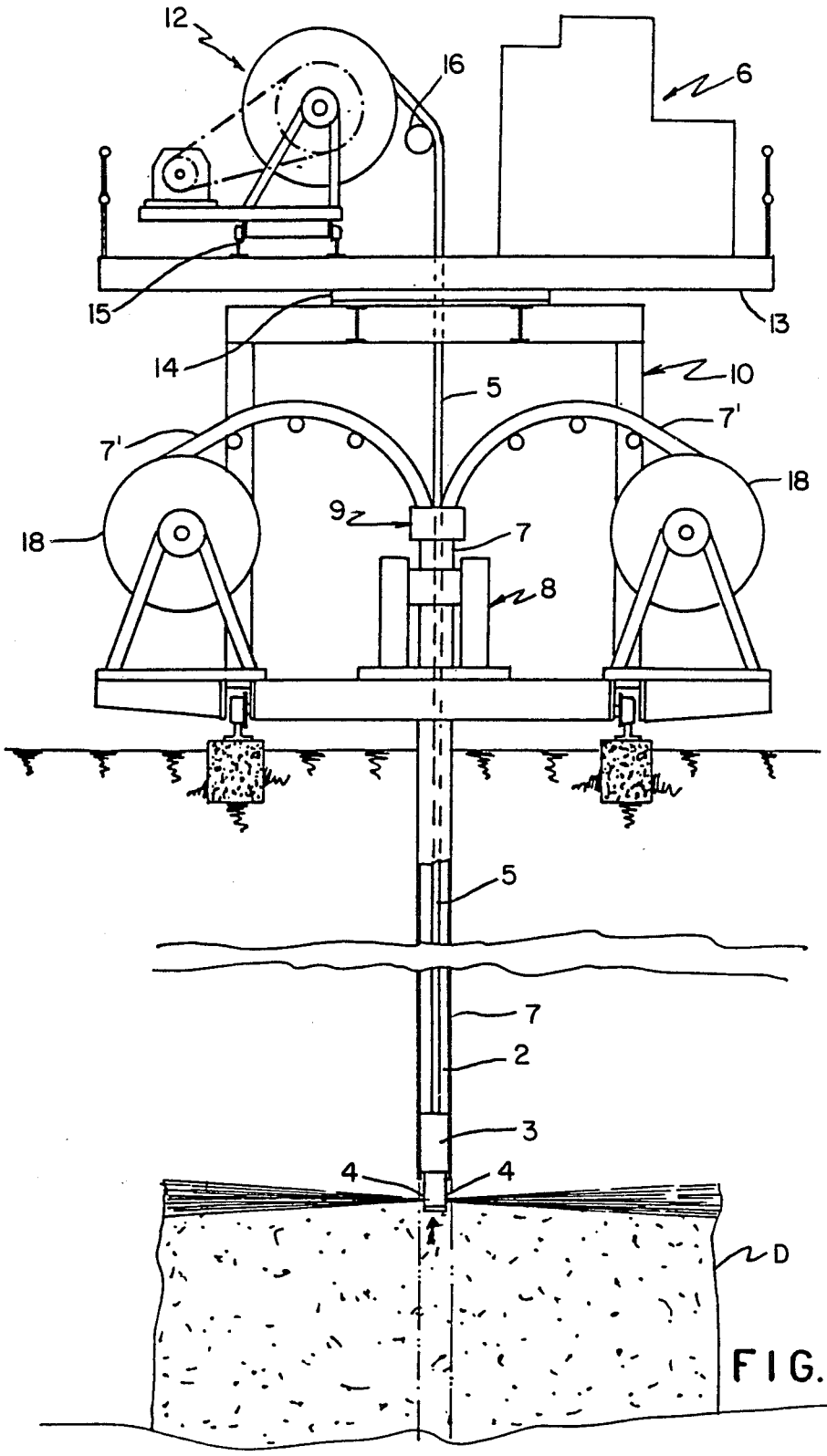
FIG. 1 is a schematic ensemble view, in vertical elevation, of the equipment used to apply the method of the present invention.

The present invention provides a method for making a generic plate-like diaphragm, and substantially comprises of first making, by ordinary known means, a hole in the ground at the depth provided for the diaphragm, in such a way as to define a long narrow cylindrical cavity 2.

Into this cavity 2 are successively inserted a head 3 which includes at least one ejection element 4 (preferably two ejection elements 4) having an axis which is substantially transverse to the axis of the cylindrical cavity 2. The head 3 is connected by means of a flexible one-piece tube 5 to an appropriate element 6 (of a known type, schematically indicated in FIG. 1) which can send the reinforcing substance (the aggregating component and any additive fluid that might be present, particularly water) under pressure to the ejection elements 4, as per currently known technology.

The head 3 is inserted to the maximum depth provided and is then drawn upward, for example, by means of the same tube 5, and at the same time that this ascent occurs, the ejection elements 4 discharge the reinforcing substance; in addition, the axes of the ejection elements 4 are at the same time kept oriented in a controlled manner in the plane perpendicular to the axis of the cavity 2. In particular, if the axes of the ejection elements 4 are pointed in the same direction and in opposite directions, keeping constant the orientation of these axes, we obtain a substantially flat plate-like diaphragm D.

This method lends itself particularly well to the formation of continuous underground barriers made up of several contiguous plate-like diaphragms joined together along the vertical edges of the ends. In this case, the method provides for first making several holes in the ground, each having the depth provided for the particular diaphragm and arranged in correspondence with the point where the middle of the diaphragm should be.

Then the head 3 is inserted into the cavity 2 of each hole; this head includes two ejection elements 4 the axes of which are transverse to the axis of the cavity and are pointed in opposite directions.

Known instrumentation is also used to determine the coordinates of the axis of each cavity 2, particularly the shifting which the axis has undergone during the drilling with respect to the intended ideal axis. This can be done with the use of known instrumentation previous to or simultaneously with the insertion of the head 3 into the cavity 2.

Then the diaphragms are made by pulling the head 3 toward the top and keeping the ejection elements 4 oriented in a controlled manner in the plane perpendicular to the axis of the cavity 2 so that the jet of reinforcing substance will reach the vertical edge of the end of the contiguous diaphragms made previously.

As an example (with reference to FIG. 5), assume that it is desired to make in the ground a barrier of contiguous diaphragms which are spread out along line A. First, holes A1, A2, A3, etc. are made in the ground along line A; the number of such holes and distance therebetween will correspond to the axes of the diaphragms to be made. However, at some depth, the real axes of the holes are inevitably (and undesirably) shifted to a greater or lesser degree with respect to the positions A1, A2, A3, etc. in the ground.

Figure 5:
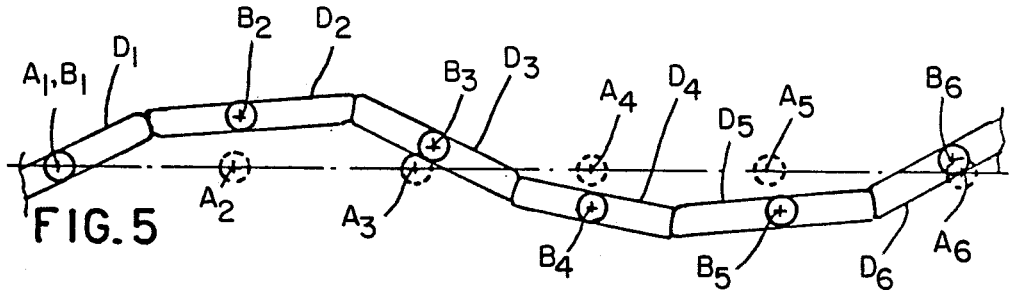
FIGS. 5 and 6 show, in a top view, the profile at an unspecified depth of continuous barriers produced by the method of the present invention.
Figure 6:
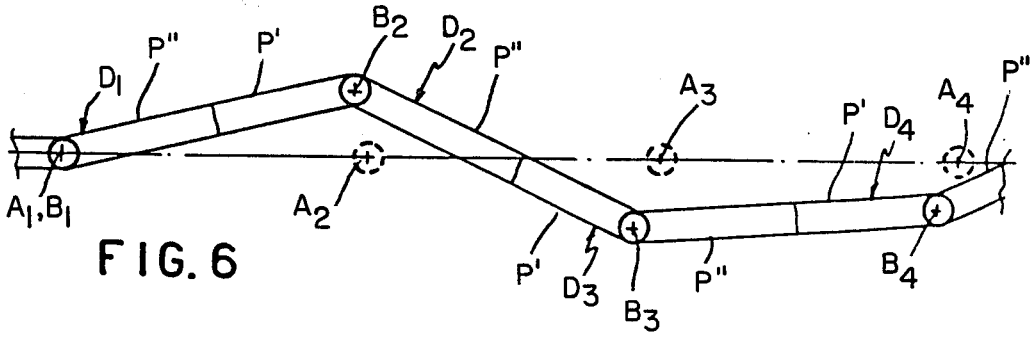

In FIG. 5, B1, B2, B3, etc. indicate the positions of the axes of these holes at an unspecified depth.

If the ejection elements 4 are oriented appropriately, it is possible to make the diaphragms D1, D2, D3, etc. so that they are connected to each other without a break along the end edges. Thus there is obtained a deep barrier with a profile in the form of a broken line which is nonetheless continuous. Obviously, this profile may vary by adaptation to the various shifts in the axes away from the ideal axis with the variation in the depth of the ground.

According to another application of the method, to make continuous barriers, the two ejection elements 4 are each oriented independently. In this case, each diaphragm D1, D2, etc. may be made up up of two portions P' and P'' which are inclined toward each other, forming a dihedron whose axis is formed from the axis of the cylindrical cavity 2. This is useful particularly when the real axes B1, B2, etc. of the cavity 2 are shifted from the ideal positions A1, A2, etc. in such a way that they cannot be corrected with the preceding method.

One particular form of applying the method of the present invention provides for inserting into the previously made hole a tubular pipe 7 which is resistant to ground pressures, and which defines the cylindrical cavity 2 with its own cavity; this pipe 7 functions as a sort of jacket for the hole (and it may be necessary in some types of earth, for example, in friable terrains), as a guide for the head 3, and for making more exact measurements of the coordinates of the axis of the cavity 2.

This pipe 7 may be inserted after the preliminary hole is made, or at the time that it is made.

During the phase of pulling the head 3 toward the top to make the diaphragm D, the pipe 7 is at the same time extracted from the ground, allowing the ejection elements 4 to project below the lower end of the tube itself.

At the same time the pipe 7 is extracted from the ground, the pipe 7 is cut longitudinally as it emerges from the ground, and at the same time the flexible tube 5 is extracted from the cut pipe while the head 3 is pulled toward the top.

The equipment used to apply the method of the present invention includes substantially the head 3 which can be inserted into the cavity 2, including at least one ejection element 4, the axis of which is substantially transverse to the axis of the cylindrical cavity 2; a one-piece flexible tube 5 which connects the head 3 to the elements 6 which supply the reinforcing and waterproofing substance under pressure; and elements which can insert the flexible tube 5 and the head 3 into the cavity 2 and extract them from it. These elements can orient the axis of the ejection element 4 in a controlled manner in the plane perpendicular to the axis of the cavity 2.

In particularly (FIG. 3), the head 3 includes two ejection elements 4, the axes of which are directed transversely and in opposite directions. Each element 4 includes an ejection nozzle 41 for the aggregating component around which are located several ejection elements 42 for the additives.

These ejection nozzles 41 and ejection elements 42 are disposed in the lower portion of a cylindrical part 31. The nozzles 41 are both connected to a hollow axial pipe 33 in the cylindrical part 31, which is connected at its top to a pipe 53 forming part of the flexible tube 5 which supplies the aggregating component. The ejection elements 42 are connected to a pair of hollow axial pipes 34 also in the cylindrical part 31, which in their upper part are joined and connected to a pipe 54 forming part of the flexible tube 5 which supplies the additive.

To the lower end of the cylinder part 31 is attached a gyrocompass 11 or another equivalent instrument, which can measure the orientation of the ejection elements 4 in the plane perpendicular to the axis of the hole.

Figure 2:
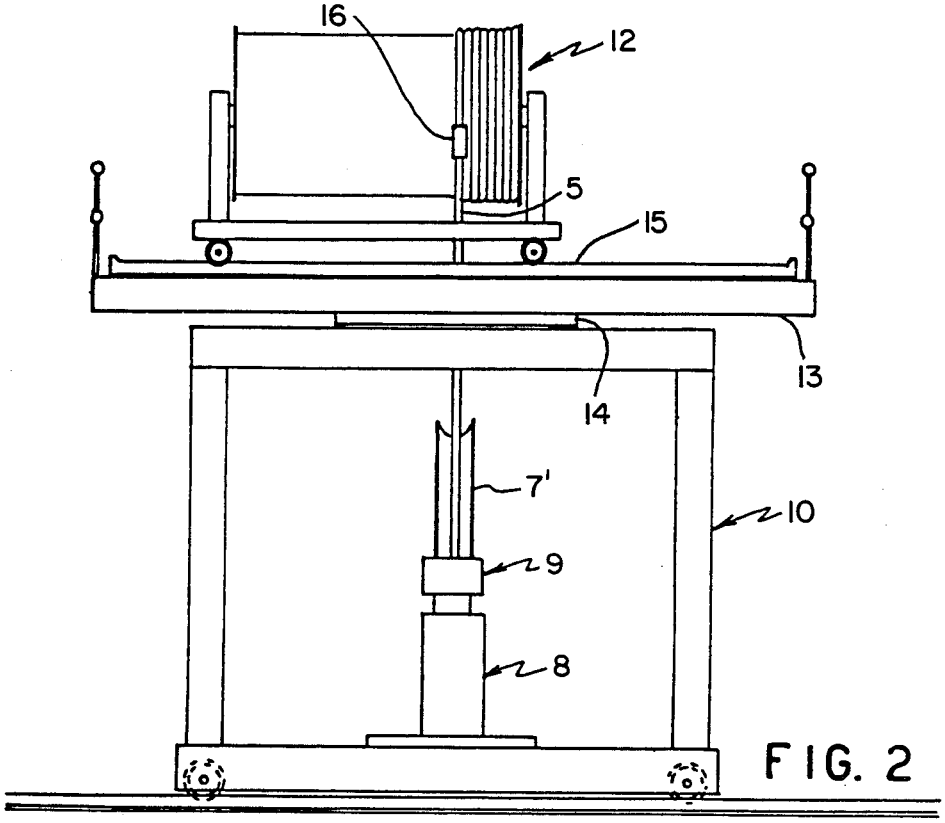
FIG. 2 is a schematic view along a vertical plane, perpendicular to the preceding one, of the equipment shown in FIG. 1, in which some parts have been left out so that others will be more visible.
Figure 3:
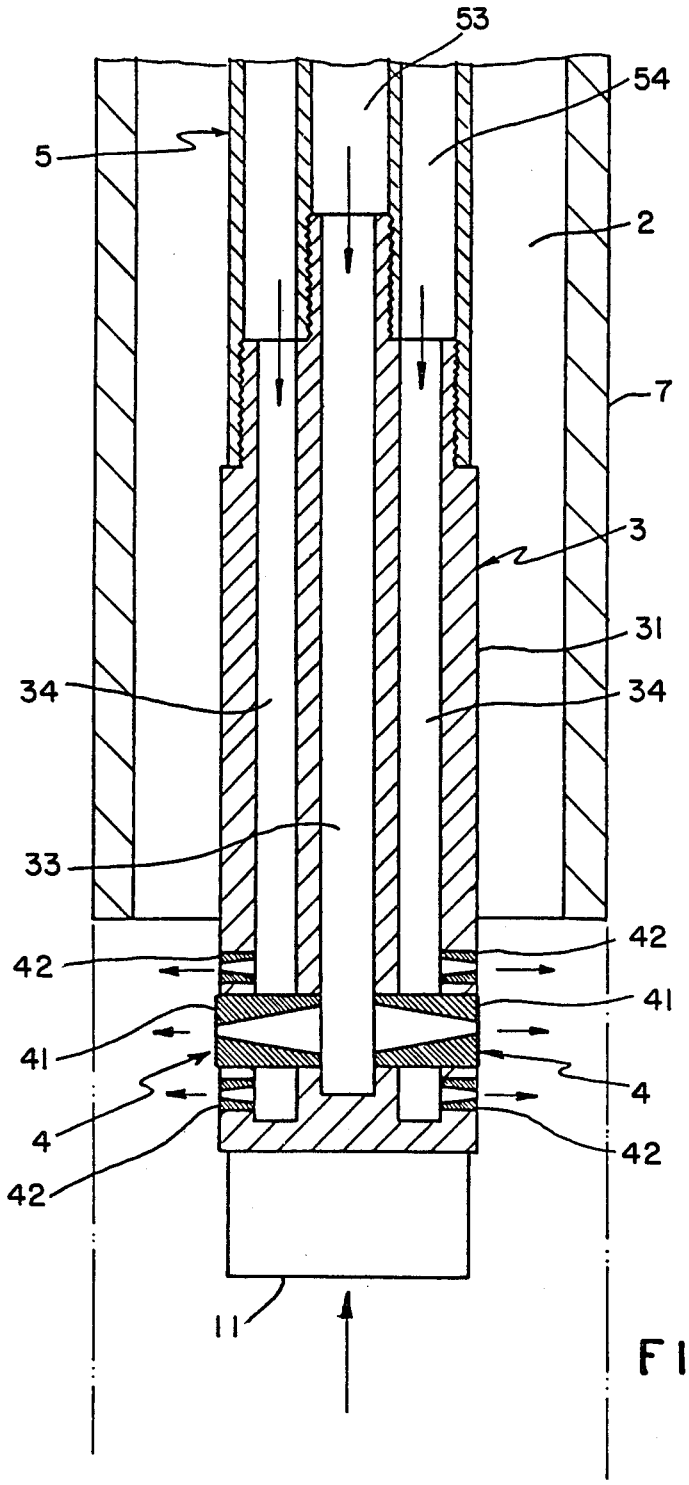
FIG. 3 shows, along an axial section, a first way of using the head.

To bring about rotation of the elements 4, in the form of the embodiment illustrated in FIGS. 1, 2, and 3 the tube 5 is designed to provide a high degree of resistance to the torsion around the axis of the tube itself. Therefore, the rotation of the element 4 is brought about by rotating the tube 5 which projects on the surface; this rotation is transmitted to the cylindrical part 31 and by means of the gyrocompass 11 the orientation of the elements 4 is kept under constant control.

On the surface, the elements for inserting and extracting the head 3 and tube 5 into and out of the cavity 2 include a winch 12 provided with a drum with a horizontal axis on which the flexible tube 5 is wound. The shaft of the drum is connected to the elements 6 which supply the reinforcement substance, and through this shaft, the reinforcement substance is sent to the flexible tube 5.

The winch 12 is supported on a base 13 which rests on elements with a center plate 14 whose rotation axis coincides with the axis of the cavity 2. The elements with the center plate 14 are supported by a large strong support frame 10. The winch 12 can slide on a pair of tracks 15 and can move forward and backward (by means of known elements not illustrated) so that, during the winding and unwinding of the tube 5 on and off the drum, the wire roll 16 of the winch 12 is kept constantly in its fixed position on the axis of the cavity 2.

The rotation of the tube 5 (causing the rotation of the ejection elements 4) is brought about by rotating the entire winch 12 on the elements with the center plate 14.

Figure 4:
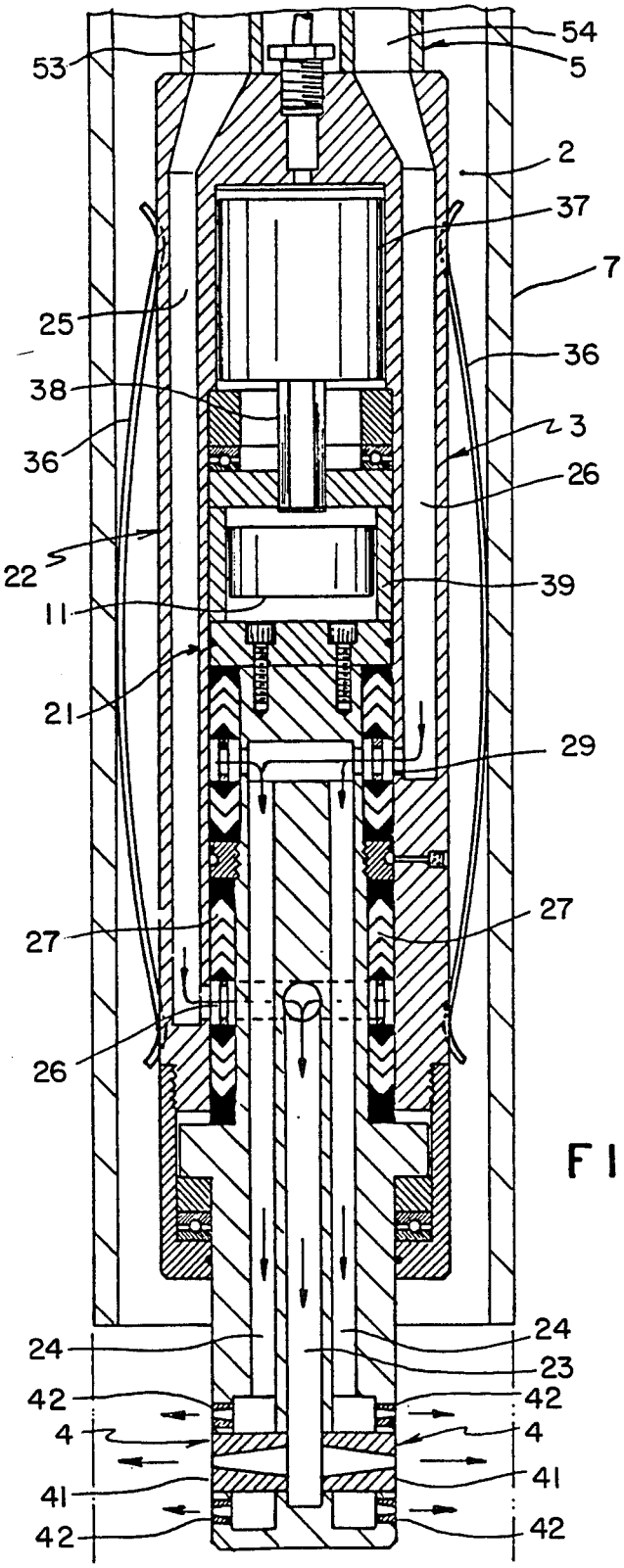
FIG. 4 shows, along an axial section, another way of using the head.

FIG. 4 shows a different embodiment of the head 3 and of the elements for bringing about the rotation of the elements 4.

In this case, the head 3 includes a cylindrical part 21 which carries, at the lower end, the ejection elements 4. In the part 21 are axial pipes 23 and 24 connected at the lower end to the elements 4. An outside envelope 22 surrounds the cylindrical part 21 and can turn freely around it. In the envelope 22 are axial pipes 25 and 26 which are connected, respectively, at their upper ends, to pipes 53 and 54 of the flexible tube 5. Between the cylindrical part 21 and the envelope 22 there is a tubular air space 27 which includes a bundle of packing which can allow the rotation of the cylindrical part 21 with respect to the envelope 22 and can insulate the air space itself from the external environment (soil and reinforcement substance). The lower ends of the pipes 25 and 26 emerge into an annular canal 28 and an annular canal 29, both in the air space 27. The upper ends of pipes 23 and 24 emerge into the canal 28 and canal 29. Therefore, by means of the pipes 53 and 25, the canal 28 and the pipe 23, the aggregating component reaches the nozzles 41; by means of the pipes 54 and 26, the canal 29 and the pipe 24, the additive component reaches the ejection elements 42.

On the envelope 22 there are elements which can impede the rotation of the envelope itself with respect to the wall of the cavity 2. For example, these elements are made up of arched elastic plates 36 which are arranged axially and compressed between the wall of the cavity 2 and appropriate axial seats on the external surface of the envelope 22. As the elastic plates 36 are compressed, they oppose the rotation of the envelope 22 with respect to the wall of the cavity 2; on the other hand, given their arching shape and their elasticity, they do not offer significant resistance to the axial slide of the head 3 in the cavity 2.

The head 3 also provides the means to produce the relative rotation of the cylindrical part 21 with respect to the envelope 22. For example, these means comprises a motor reducer 37, which is inserted and forms a single piece with the upper part of the envelope 22, the shaft 38 of which sets in rotation a part 39 which forms a single piece with the top of the cylindrical part 21. In the part 39 is a gyrocompass 11. The rotation of the elements 4 is brought about by activation of the motor reducer 37, and the gyrocompass 11 can be used to keep the orientation of the elements 4 under control.

When the tubular pipe 7 is used to define the cavity 2, means 8 are provided to extract the pipe 7 (indicated schematically in FIGS. 1 and 2) at the same time that the tube 5 and the head 3 are extracted, and means 9 (indicated schematically in FIGS. 1 and 2) to cut longitudinally the segment of the pipe 7 which emerges from the ground as it is extracted.

While the pipe 7 is cut into two longitudinal parts 7' these parts are, for example, wound around large drums 18.

The elements 8 and 9 are preferably arranged in the lower part of the support frame 10 under the winch 12. The support frame 10 may be movable on rollers installed on the ground.

The present invention offers two types of advantages. The first is in the fact that, since the tube 5 which connects the head 3 to the elements 6 which supply the reinforcing substance is an uninterrupted and flexible tube, it can be easily and rapidly inserted into the cavity 2 and withdrawn from it. In addition, construction difficulties and the risk of leakage through joints, which are illustrated above and which are present in the known technique, are eliminated.

The second type of advantage is in the fact that, with the present invention, it is possible to make continuous barriers comprised of diaphragms which are efficiently and accurately joined together.

It will be clear that numerous practical variants are possible in this invention without deviating from the framework of the inventive idea as claimed below.

What is claimed is:

1. A method for molding underground contiguous plate-like diaphragms, particularly for shallow areas, comprising:

(a) making a hole in the ground at a depth planned for one of the diaphragms, the hole defining a long narrow cylindrical cavity and the location of the hole selected to correspond to the middle of the diaphragm to be formed;

(b) successively inserting into the cavity of a head comprising at least two elements for ejection, the elements directed in substantially opposite directions and the axes of the two elements being substantially transverse to the axis of the cavity, the head being connected by means of a flexible one-piece tube to elements which supply a reinforcing and waterproofing substance under pressure to the ejection elements;

(c) determine the coordinates of the axes of the elements;

(d) sending through the ejection elements the reinforcement and waterproofing substance while pulling the head toward the top and maintaining the axes of the ejection elements oriented in a controlled manner in the plane perpendicular to the axis of the cavity; and (e) repeating steps (a) through (d) above to form other diaphragms, and after the first diaphragm has been formed, maintaining the ejection elements oriented as in step (d) so that the jet of the reinforcing and waterproofing substance reaches the vertical end edge of a previously formed and contiguous diaphragm.

2. A method for molding underground diaphragms particularly for shallow areas, comprising:

making a preliminary hole in the ground at a depth planned for the diaphragm which defines a long narrow cylindrical cavity;

inserting into the preliminary hole simultaneously, or successively to the formation of the hole, a tubular pipe which substantially lines the cylindical cavity of the hole, the tubular pipe defining a long narrow cylindrical cavity in the hole;

successively inserting into the cavity a head comprising at least one element for ejection, the axis of which is substantially transverse to the axis of the cavity, the head being connected by means of a flexible one-piece tube to elements which supply a reinforcing and waterproofing substance under pressure to the ejection element;

sending through the ejection element the reinforcement and waterproofing substance while pulling the head toward the top and maintaining the axis of the ejection element oriented in a controlled manner in the plane perpendicular to the axis of the cavity;

extracting the tubular pipe from the ground at the same time that the head is pulled toward the top while allowing the ejection element to project below the lower end of the pipe itself;

longitudinally cutting the tubular pipe which emerges from the ground at the same time that it is extracted from the ground; and extracting the flexible tube from the cut pipe as the head is pulled toward the top.

3. An apparatus for molding underground diaphragms comprising:

a head which can be inserted into a cylindrical cavity which was made previously in the ground, the head including at least one ejection element the axis of which being substantially transverse to the axis of the cylindrical cavity;

means for supplying a reinforcement and waterproofing substance into the cylindrical cavity;

a one-piece flexible tube which connects the head to the means supplying reinforcement and waterproofing substance under pressure;

means for inserting and extracting the flexible tube and the head from the cylindrical cavity, the means for inserting and extracting the flexible tube and the head comprises a winch equipped with a drum around which the flexible tube is wound, the drum having a shaft which is connected with the means for supplying the reinforcement and waterproofing substance; and means for orienting, in a controlled manned, the axis of the ejection element in the plane perpendicular to the axis of the cylindrical cavity.

4. The apparatus of claim 3 wherein the flexible tube has a high degree of resistance to torsion, and wherein the means for orienting the axis of the ejection element comprises a winch supported on a base which can rotate around an axis which coincides with the axis of the cavity.

5. An apparatus for molding underground diaphragms comprising:

a head which can be inserted into a cylindrical cavity which was made previously in the ground, the head including at least one ejection element the axis of which being substantially transverse to the axis of the cylindrical cavity, the head comprising:

a cylindrical part which carries the ejection elements;

an external envelope which surrounds a cylindrical part and can rotate freely around it;

means for impeding the rotation of the external envelope with respect to the wall of the cylindrical cavity; and means for providing relative rotation of the cylindrical part with respect to the external envelope;

means for supplying a reinforcement and waterproofing substance into the cylindrical cavity;

a one-piece flexible tube which connects the head to the means supplying reinforcement and waterproofing substance under pressure, the ejection elements of the head being contained in axial pipes which are connected to the flexible tube and to the ejection elements;

means for inserting and extracting the flexible tube and the head from the cylindrical cavity; and means for orienting, in a controlled manner, the axis of the ejection element in the plane perpendicular to the axis of the cylindrical cavity.

6. An apparatus for molding underground diaphragms comprising:

a head which can be inserted into a cylindrical cavity which was made previously in the ground, the head including at least one ejection element the axis of which being substantially transverse to the axis of the cylindrical cavity;

means for supplying a reinforcement and waterproofing substance into the cylindrical cavity;

a one-piece flexible tube which connects the head to the means supplying reinforcement and waterproofing substance under pressure;

means for inserting the flexible tube and the head from the cylindrical cavity;

means for orienting, in a controlled manner, the axis of the ejection element in the plane perpendicular to the axis of the cylindrical cavity;

means for extracting the tubular pipe; and means for longitudinally cutting the segment of pipe which emerges from the ground as it is extracted.

* * * * *

UNITED STATES PATENT AND TRADEMARK OFFICE

CERTIFICATE OF CORRECTION

PATENT NO. : 4,867,240

DATED : September 19, 1989

INVENTOR(S) : Romano Colla

It is certified that error appears in the above-identified patent and that said Letters Patent is hereby corrected as shown below:

In column 3, line 53, "made up up" should read --made up--. In column 7, line 38, "controlled manned" should read --controlled manner--.

Signed and Sealed this

Thirtieth Day of October, 1990

*Attest:*

HARRY F. MANBECK, JR.

*Attesting Officer*

*Commissioner of Patents and Trademarks*